United States Patent [19]

Baier

[11] Patent Number: 4,712,569

[45] Date of Patent: Dec. 15, 1987

[54] PIPE STEM REPLACEMENT KIT

[76] Inventor: Alfred S. Baier, 91 Pleasant St., Apt. D-1; P.O. Box 113, Medfield, Mass. 02052

[21] Appl. No.: 826,678

[22] Filed: Feb. 6, 1986

[51] Int. Cl.[4] ..... A24F 9/00

[52] U.S. Cl. ..... 131/328; 131/329; 131/225; 131/227

[58] Field of Search ..... 131/225, 227, 328, 329

[56] References Cited

U.S. PATENT DOCUMENTS 228,099 5/1880 Mitchell ..... 131/227

999,626 8/1911 Burger ..... 131/225

1,541,346 6/1925 Goldvogel ..... 131/225

*Primary Examiner*—V. Millin

*Attorney, Agent, or Firm*—William Nitkin

[57] ABSTRACT

A pipe stem replacement kit having a plurality of tenons of different diameters, each tenon having one cylindrical side and one threaded side, a pipe stem having at one end a mouthpiece and at the other end a threaded aperture to receive the threaded end of a selected one of said tenons, sandpaper to sand down the tenon to fit the pipe shank aperture and wax to apply to the tenon to ease the insertion of the tenon into the pipe shank aperture.

3 Claims, 3 Drawing Figures

PIPE STEM REPLACEMENT KIT

BACKGROUND OF THE INVENTION

1. Field of the Invention

This invention relates to a pipe stem replacement kit and more particularly relates to a kit which allows an individual to repair his pipe by replacing the broken pipe stem with the pipe stem of this kit.

2. Description of the Prior Art

In order to replace a broken pipe stem, a pipe smoker has had to send his pipe to a repair shop and wait for a long period of time for the stem to be professionally replaced. The replacement of a pipe stem at such repair shop often involves complex turning of the stem on a lathe to be sure that the new stem will fit the pipe properly. Pipe stems have a tenon which fits into an aperture in the shank of the pipe. The size of the aperture in the shank of a pipe can differ from pipe to pipe. Many pipes are made from rare woods especially suited for use in pipes and are highly prized by their owners. Should the stem break or become defective in some way, then the pipe is unusable until the stem is replaced.

SUMMARY OF THE INVENTION

In order to avoid the delays of pipe stem repair encountered in the prior art, the kit of this invention allows a pipe smoker to easily, quickly and inexpensively repair his own pipe himself should a stem problem arise. The kit of this invention is provided with either a straight stem or a curved stem as the user desires. A plurality of tenons of different diameters having threads at one end thereof and being cylindrical at the other end thereof is provided. For example a ⅜ inch tenon, a 5/16 inch tenon and a ¼ inch tenon can be included in the kit, all of which which can be contained within a single bag. The cylindrical portion of the tenon is adapted to fit into the aperture in the shank of the pipe. One selects a tenon which is somewhat larger than or which fits exactly within the shank aperture. If the tenon is too large, one can sand it roughly down using the rough sandpaper enclosed within the kit until it can just be inserted, and then it can be smoothed down further using the fine sandpaper also enclosed within the kit of this invention. A portion of wax to be rubbed around the tenon is also enclosed to make insertion easier. The tenon, having screw threading on its other end, is then screwed into the aperture in the pipe stem of this kit which has corresponding threading and then, holding the stem, one inserts the tenon into the aperture in the shank of the pipe until the stem touches the pipe at which point the repair is completed with the new stem in position. Should further stem replacement be needed, one merely has to unscrew the stem and replace it with a stem from another kit of this invention which replacement stem has matching threads to the threaded portion of the tenon protruding from the shank aperture of the pipe.

In many cases repairs can present difficulties in matching the stem diameter to the outer diameter of the shank of the pipe around the shank aperture. It has been found that if the end adjacent to the pipe shank is curved inward, an aesthetic appearance is provided, and it is not necessary to match perfectly the outer diameter of the pipe shank for the repair to be and look satisfactory.

DESCRIPTION OF THE PREFERRED EMBODIMENT(S)

Figure 1:
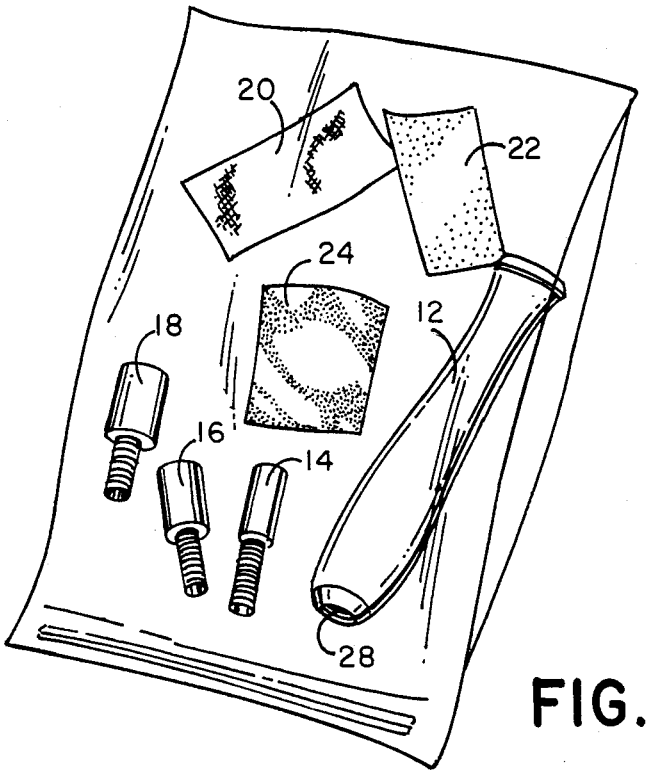
FIG. 1 illustrates the kit of this invention.

Disclosed herein is an inexpensive kit for the repair of broken pipe stems which repair at a pipe repair shop can frequently cost many times the cost of the kit of this invention. The kit can be held within a plastic bag as seen in FIG. 1 and can contain instructions for use, a plurality of tenons 14, 16 and 18, replacement stem 12, pieces of rough and fine sandpaper 22 and 24 respectively, and a portion of wax 20.

Figure 2:
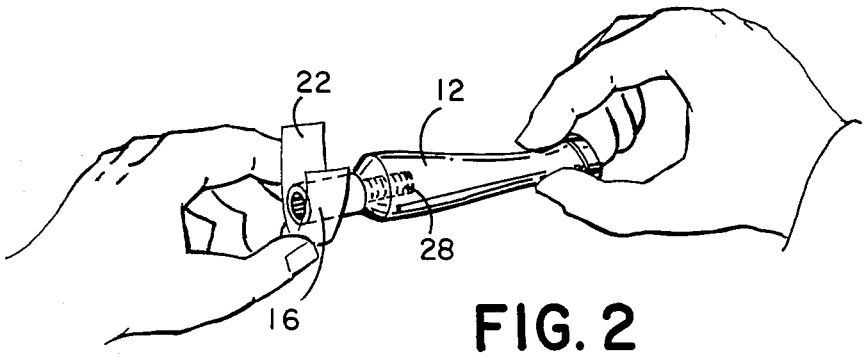
FIG. 2 illustrates the sanding of the tenon for it to fit the shank aperture.
Figure 3:
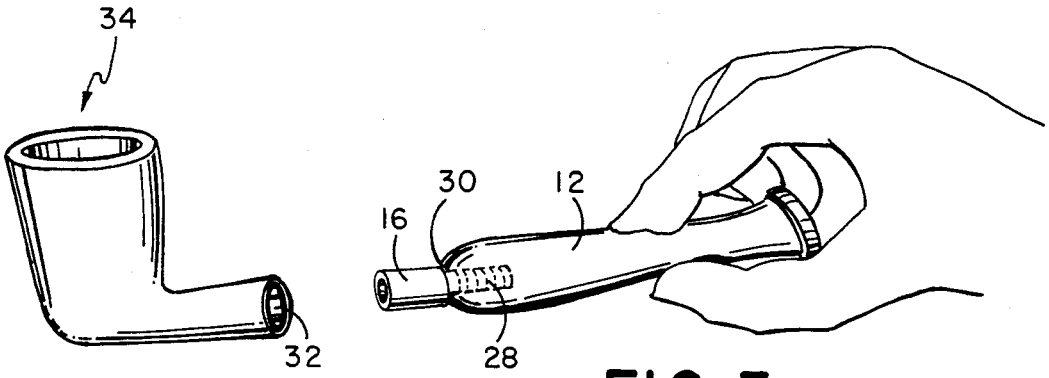
FIG. 3 illustrates screwing in of the tenon into the stem and the direction of the insertion of the stem with the fitted tenon into the pipe shank aperture.

As seen in FIG. 2, the user of the kit of this invention first selects a tenon which most closely fits the shank aperture of his pipe without being too small therefor. The tenons in the kit are provided in a plurality of diameter sizes, for example ⅜ inch, 5/16 inch and ¼ inch. Tenons of other diameters can also be provided depending on the size of the pipe shank aperture. Once the appropriate tenon such as tenon 16 has been selected, it can be screwed in threaded aperture 28 in stem 12 provided in the kit which allows easy grasping of the relatively small tenon for the further procedures. One can then take the piece of rough sandpaper 22, wrap it around tenon 16 and carefully rotate the stem to evenly sand the tenon until it fits snugly within pipe shank hole 32 of pipe 34 as seen in FIG. 3. One should sand and check fit then tenon many times during this process. Once the tenon appears to fit properly, one can use fine sandpaper 24 in the same way by wrapping it around the tenon and rotating the sandpaper or the tenon until the tenon is relatively smooth. Wax 24 is provided on a sheet of paper which can be rubbed thoroughly around the tenon to act as a lubricant so that the tenon will be easily inserted into pipe shank aperture 32 or removed therefrom if desired for cleaning the pipe. One then inserts the tenon in the pipe shank aperture by twisting the stem in a clockwise direction. If the tenon does not go into the pipe shank aperture 32 easily, it must be removed and sanded a bit more. After the stem has been fitted properly, one should leave the tenon permanently in place within the pipe shank. If one wishes to remove the stem for cleaning, one can unscrew it off the other threaded end of the tenon by rotating the stem counterclockwise.

One feature of the stem provided in the kit of this invention is that end 30 of the stem to be adjacent to the shank of the pipe is curved inward as seen in FIG. 3 and this design provides an aesthetic appearance while avoiding the necessity for finding a stem which exactly matches the diameter of the pipe shank.

Although the present invention has been described with reference to particular embodiments, it will be apparent to those skilled in the art that variations and modifications can be substituted therefor without departing from the principles and spirit of the invention.

I claim:

1. A pipe stem replacement kit for user repair of a pipe of the type having an air-flow channel therein leading to a pipe, comprising:

a replacement pipe stem having at one end a mouth piece and having at the other end a threaded aperture defined therein, said threaded aperture being continuous with the air flow of said pipe stem, said pipe stem being curved inwardly at the end having said threaded aperture;

a plurality of tenons having different diameters, each tenon having at one end a cylindrical portion and having at the other end a threaded portion with an aperture therethrough for the passing of said air flow, said threaded portion adapted to be inserted and screwed into said threaded aperture in the end of said stem opposite said mouthpiece;

sandpaper for sanding the cylindrical portions of said tenon for insertion into said pipe;

wax to act as a lubricant when applied to said tenon before insertion of said sanded tenon into said pipe;

whereby said kit is to be utilized by determining the diameter of the shank aperture in the pipe in which said replacement pipe stem is to be placed, selecting an appropriate tenon; sanding and testing the fit of the selected tenon by screwing said tenon into said pipe stem, and waxing said tenon for easy insertion of said tenon into said pipe stem aperture until said pipe stem is in place in said pipe.

2. A method of using a kit for user repair by replacement of a pipe stem of a pipe, comprising the steps of:

determining the size of the aperture defined in the pipe shank of said pipe;

selecting a tenon having a diameter of an appropriate size from a plurality of tenons provided in said kit, each of said tenons having a cylindrical end and a threaded end with an aperture passing therethrough for the flow of air through said pipe;

testing the fit of said tenon by screwing said selected tenon into a mating aperture on the pipe stem provided in said kit;

sanding said tenon with sandpaper provided in said kit until it is of a size to fit into the pipe shank aperture;

waxing said tenon protruding from said stem;

inserting said tenon by placing it into said shank aperture; and rotating said stem until said pipe stem is against said pipe shank and said tenon is fully inserted into said shank aperture.

3. The method of claim 2 further including the step of removing said pipe stem by rotating said stem until it unscrews from said tenon which remains in said pipe aperture shank.

* * * * *